US008393816B1

(12) United States Patent
Schumacher

(10) Patent No.: US 8,393,816 B1
(45) Date of Patent: Mar. 12, 2013

(54) MARKING AND INDICATING MEANS FOR EMERGENCY PERSONNEL

(76) Inventor: John D. Schumacher, Sergeant Bluff, IA (US)

( * ) Notice: Subject to any disclaimer, the term of this patent is extended or adjusted under 35 U.S.C. 154(b) by 365 days.

(21) Appl. No.: 12/772,505

(22) Filed: May 3, 2010

Related U.S. Application Data

(60) Provisional application No. 61/214,972, filed on May 1, 2009.

(51) Int. Cl.
*B43K 5/14* (2006.01)

(52) U.S. Cl. ..... 401/133; 362/118; 427/429; 401/132

(58) Field of Classification Search ..... 401/133–135, 401/198, 199; 362/118; 252/700; 106/31.13; 427/429
See application file for complete search history.

(56) References Cited

U.S. PATENT DOCUMENTS

| | | | | |
|---|---|---|---|---|
| 2,977,320 | A * | 3/1961 | Jenkins | 427/286 |
| 3,463,915 | A | 8/1969 | Day | |
| 3,813,534 | A * | 5/1974 | Gilliam | 362/34 |
| 4,064,428 | A * | 12/1977 | Van Zandt | 362/34 |
| 4,814,949 | A | 3/1989 | Elliott | |
| 5,174,814 | A | 12/1992 | Burwell et al. | |
| 5,344,670 | A * | 9/1994 | Palmer et al. | 427/157 |
| 5,961,199 | A * | 10/1999 | Lee | 362/34 |
| 6,056,737 | A * | 5/2000 | Rosen | 606/1 |
| 6,881,000 | B2 * | 4/2005 | Perlman et al. | 401/198 |
| 8,061,917 | B2 * | 11/2011 | Stenton et al. | 401/134 |
| 2007/0079722 | A1 | 4/2007 | Parish | |
| 2010/0091478 | A1 * | 4/2010 | Miller | 362/34 |

* cited by examiner

*Primary Examiner* — David Walczak
*Assistant Examiner* — Jennifer C Chiang
(74) *Attorney, Agent, or Firm* — Montgomery Patent & Design LLC; Robert C. Montgomery

(57) ABSTRACT

A glow-in-the-dark marking pen that is intended for use for marking structures during search and rescue operations, particularly during a fire, is herein disclosed. The glow-in-the-dark properties of the ink are activated by breaking an inner glass tube contained within the plastic marker body and shaking it. The cap is removed and the pen can be used upon various surfaces as needed. The glow-in-the-dark ability of the ink allows others to see writing in diminished lighting environments, such as emergency personnel who wish to alert other personnel that a room of a structure is being checked or has been checked.

17 Claims, 5 Drawing Sheets

MARKING AND INDICATING MEANS FOR EMERGENCY PERSONNEL

RELATED APPLICATIONS

The present invention was first described in and claims the benefit of U.S. Provisional Patent No. 61/214,972 filed May 1, 2009, the entire disclosures of which are incorporated herein by reference.

FIELD OF THE INVENTION

The present invention relates generally to marking or writing devices, and in particular, to a marking utensil particularly adapted for temporary marking of structures in low or no light conditions.

BACKGROUND OF THE INVENTION

One (1) of the most critical tasks that firemen perform during a structure fire is that of checking the structure for occupants. This is most often done on a room-by-room basis. However, as with any task performed in an unfamiliar environment under duress, mistakes are bound to occur. Perhaps the most common is that of omitting a room or even checking it twice by the same or different firemen. Such situations result in wasted time or the loss of life simply due to the fact that it is difficult to discern or label a room as checked.

Regular markers are very thin and difficult to see in low light conditions. Other methods such as spray paint are time consuming and a fire hazard, as well as still difficult to see in low light conditions.

Various attempts have been made to provide chemiluminescent devices. Examples of these attempts can be seen by reference to several U.S. patents. U.S. Pat. No. 4,814,949, issued in the name of Elliott, describes a means for producing chemiluminescent devices in the shape of a heart, arrow, or the like in order to provide a visible shape in low light conditions.

U.S. Pat. No. 6,881,000, issued in the name of Perlman et al., describes a phosphorescent marker for laboratory autography.

While these devices fulfill their respective, particular objectives, each of these references suffer from one (1) or more of the aforementioned disadvantages. Many such devices are not adapted for writing or marking. Also, many such devices are not easy to utilize in emergency situations. Furthermore, many such devices have short periods of functionality or only leave markings for a short amount of time. In addition, many such devices are not usable for marking surfaces such as walls, doors, and the like. Accordingly, there exists a need for a marking and indicating means without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a device which allows emergency personnel to quickly and selectively provide markings on surfaces such as doors, walls, and the like which are quickly and easily discernable in low or no light conditions. Thus, the object of the present invention is to solve the aforementioned disadvantages and provide for this need.

To achieve the above objectives, it is an object of the present invention to enable a user to denote an illuminating indication on a surface to other persons in low light or no light conditions for an extended period of time. The apparatus takes the form of a glow-in-the-dark lighting utensil which comprises a container, an applicator, a cap, and a vial.

Another object of the present invention is to selectively combine substances within the container in order to provide a chemiluminescent reaction which enables a user to denote a desired location on a desired item or location.

Yet still another object of the present invention is to provide common ergonomic writing functionality for a user by comprising a shape similar to a conventional bingo marker or the like.

Yet still another object of the present invention is to provide a means for a user to apply and dispense the substances mixture onto a desired surface. The applicator is located on a central upper portion of the container and comprises an applicator tip constructed of a wide-tip porous material which wicks the substance mixture upwardly from the container.

Yet still another object of the present invention is to prevent mixing and subsequent fading of the chemiluminescent mixture by allowing a user to quickly and selectively mix the substances immediately prior to use. An interior portion of the container comprises a dual chamber vial which separately houses a plurality of chemicals such as phenyl oxalate ester, fluorescent dye solution, and a hydrogen peroxide solution which when mixed provide a temporary chemiluminescent function.

Yet still another object of the present invention is to allow a user to easily mix the substances by breaking the glass vial via a twisting or bending motion of the container.

Yet still another object of the present invention is to provide a selective covering and protecting function to the applicator tip via a friction fit cap.

Yet still another object of the present invention is to provide a method of utilizing the device that provides a unique means of breaking the vial, mixing the contained substances, removing the cap, selectively marking desired surfaces with desired indicia, and easily viewing the markings in low or no light conditions.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
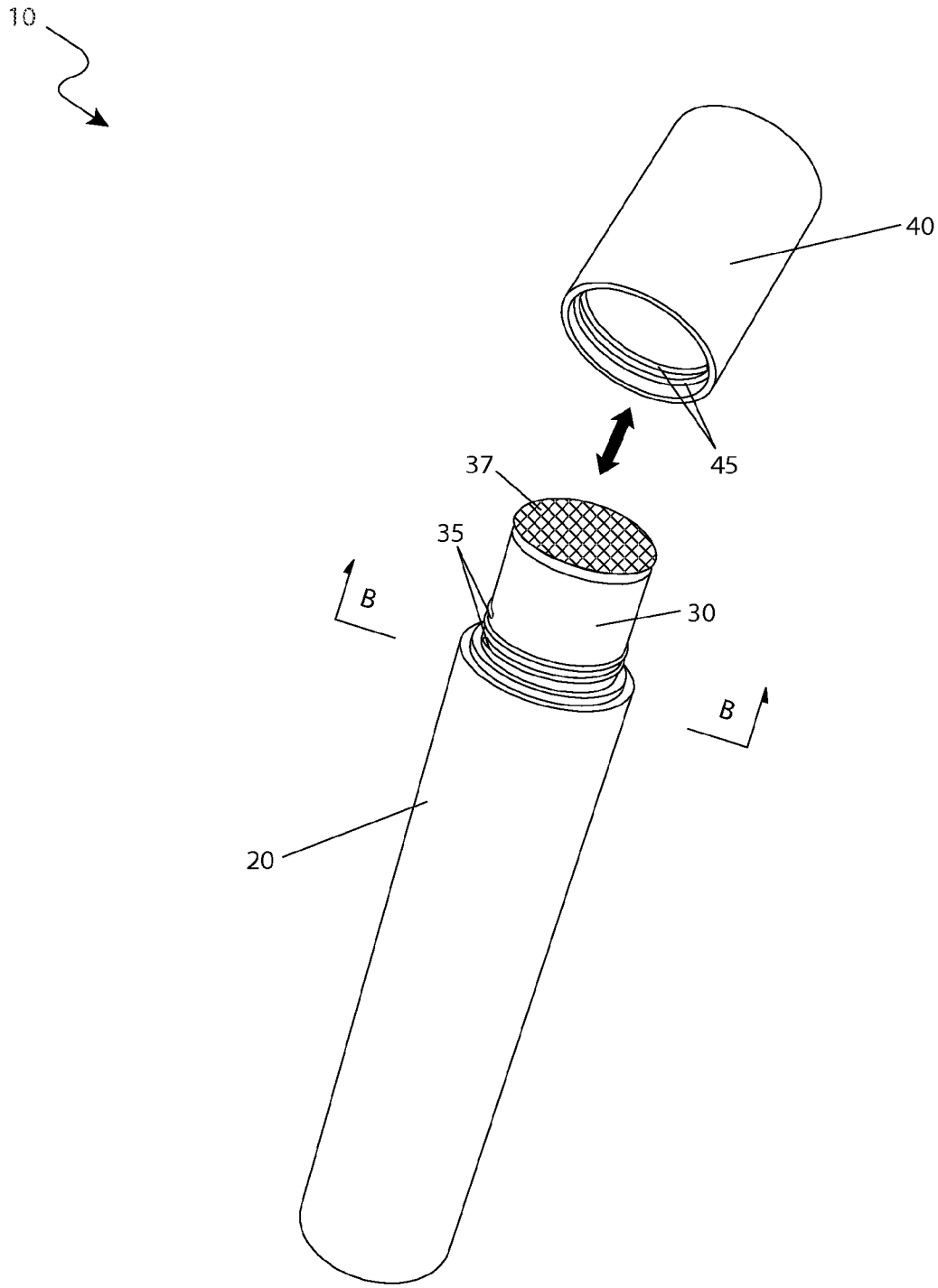
FIG. 1 is a perspective view of a marking and indicating means for emergency personnel 10, according to a preferred embodiment of the present invention.

| | |
|---|---|
| 10 | marking and indicating means for emergency personnel |
| 20 | container |
| 25 | interior portion |
| 30 | applicator |
| 35 | applicator thread |
| 37 | applicator tip |
| 38 | ledge |
| 40 | cap |
| 45 | cap thread |
| 50 | vial |
| 55 | divider |
| 60 | first substance |
| 70 | second substance |
| 80 | substance mixture |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a marking and indicating means for emergency personnel (herein described as the "apparatus") 10, comprising a glow-in-the-dark writing utensil which enables a user to denote an illuminating indication on a surface to other persons in low light or no light conditions for an extended amount of time preferably up to twelve (12) hours. The apparatus 10 comprises a container 20, an applicator 30, a cap 40, and a vial 50. The apparatus 10 is ideal for emergency personnel, firefighters, triage work, or the like.

Referring now to FIG. 1, a perspective view of the apparatus 10, according to the preferred embodiment of the present invention, is disclosed. The apparatus 10 comprises a cylindrical container 20 which houses the vial 50, a first substance 60, and a second substance 70 (see FIG. 2). The substances 60, 70 combine within the container 20 to form a substance mixture 80 which provides a chemiluminescent reaction to the apparatus 10 which enables the user to denote a desired indication on a desired item or location. The container 20 is comprised of a flexible plastic which enables an external pressure to be applied to break the internal vial 50 and enable the container 20 to rebound back into its original shape for marking on items such as, but not limited to: walls, doors, or the like. The applied external pressure is preferably introduced via the user squeezing the container 20 inwardly, yet other means of external pressure may be incorporated without limiting the scope of the apparatus 10. The container 20 is similar in shape to a common bingo marker or a common shoe polish dispenser. The container 20 measures approximately seven (7) inches in length and is attached via integral molding to the applicator 30.

The applicator 30 provides a means for the user to apply and dispense the substances mixture 80 onto the desired surface. The applicator 30 is located on a central upper portion of the container 20 and comprises a plurality of applicator threads 35 and an applicator tip 37. The applicator threads 35 engage a plurality of cap threads 45 located on an inner perimeter surface of a cap 40. The cap 40 is a removably attachable cylindrical plastic lid which provides the applicator 30 with a covering and sealing means to the applicator tip 37. The applicator tip 37 is comprised of a wide-tip porous material which is preferably felt, yet other materials may be utilized without limiting the scope of the apparatus 10. The applicator tip 37 protrudes from an upper surface of the applicator 30 (also see FIG. 5). The applicator tip 37 wicks the substance mixture 80 upwardly to enable the user to transfer said substance mixture 80 onto a desired location. The applicator 30 measures approximately one-and-one-eighth (1⅛) square inches.

Figure 2:
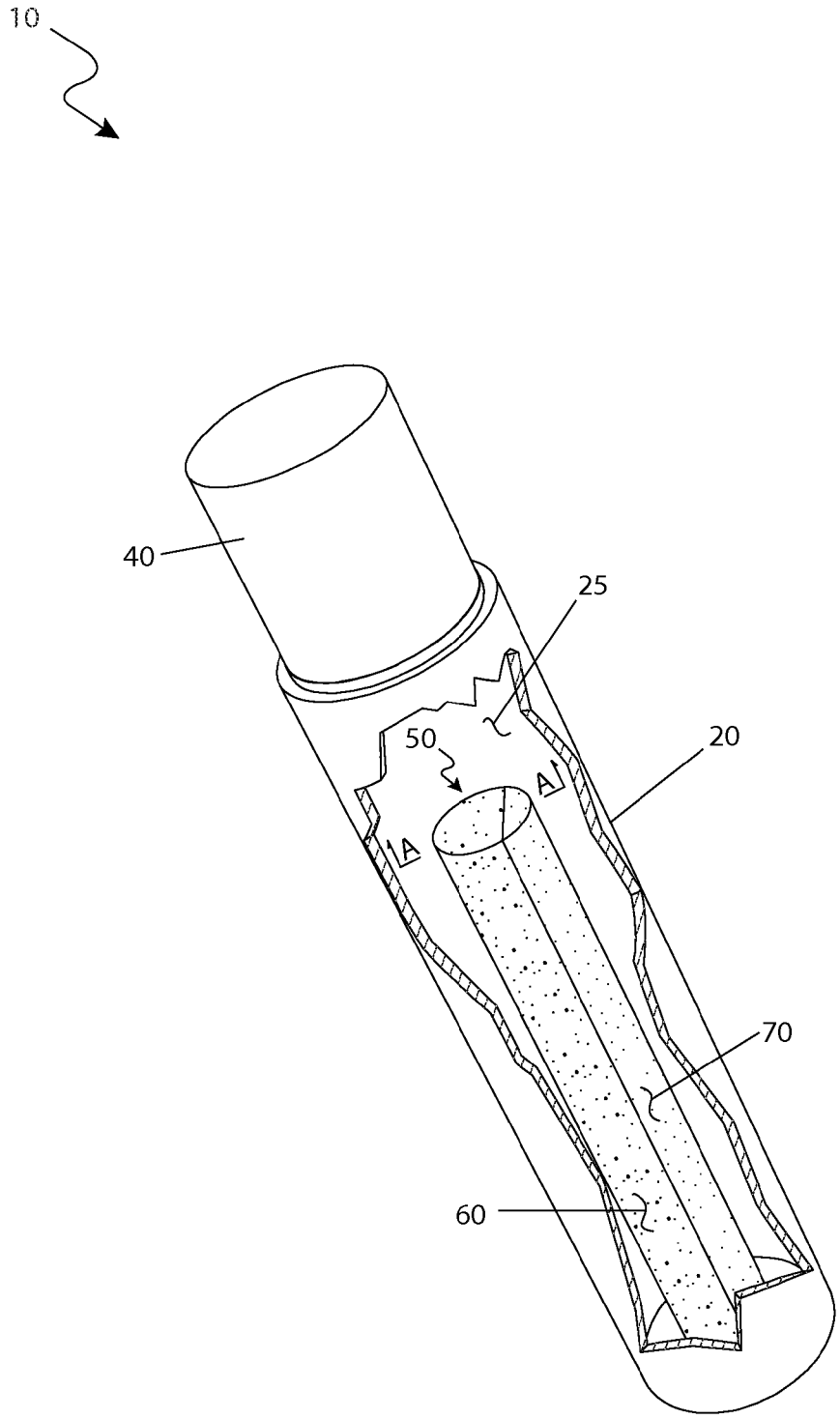
FIG. 2 is a break-away view of the marking and indicating means for emergency personnel 10 depicting a vial 50, according to a preferred embodiment of the present invention.
Figure 3:
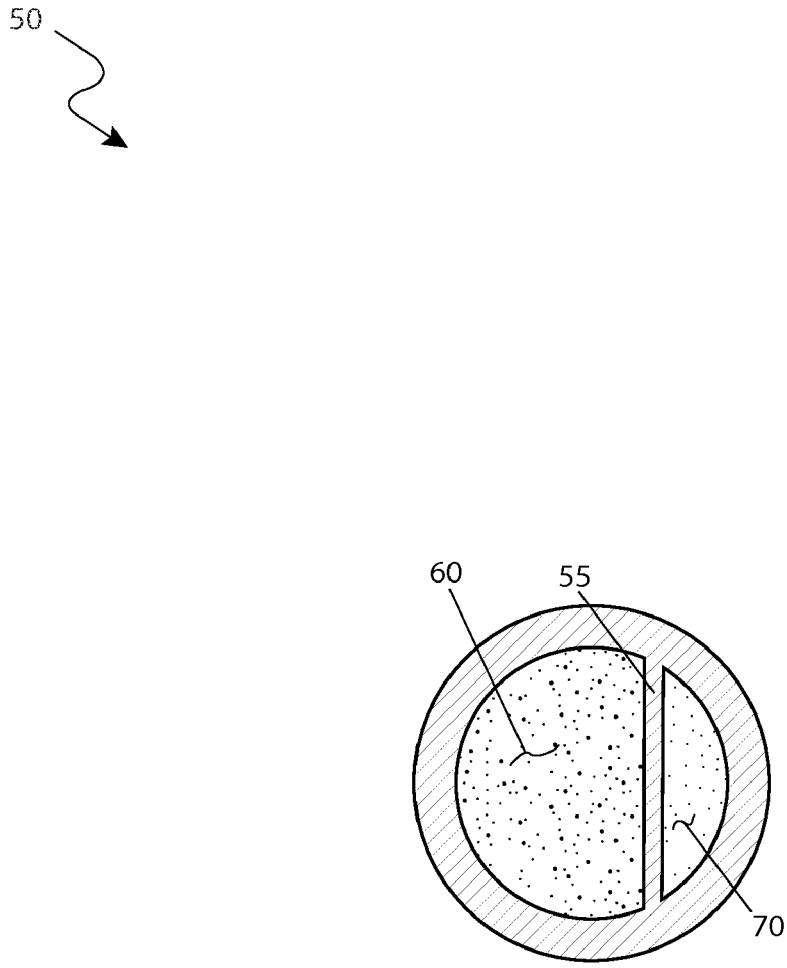
FIG. 3 is a section view of the vial 50 taken along line A-A (see FIG. 2), according to a preferred embodiment of the present invention.
Figure 4:
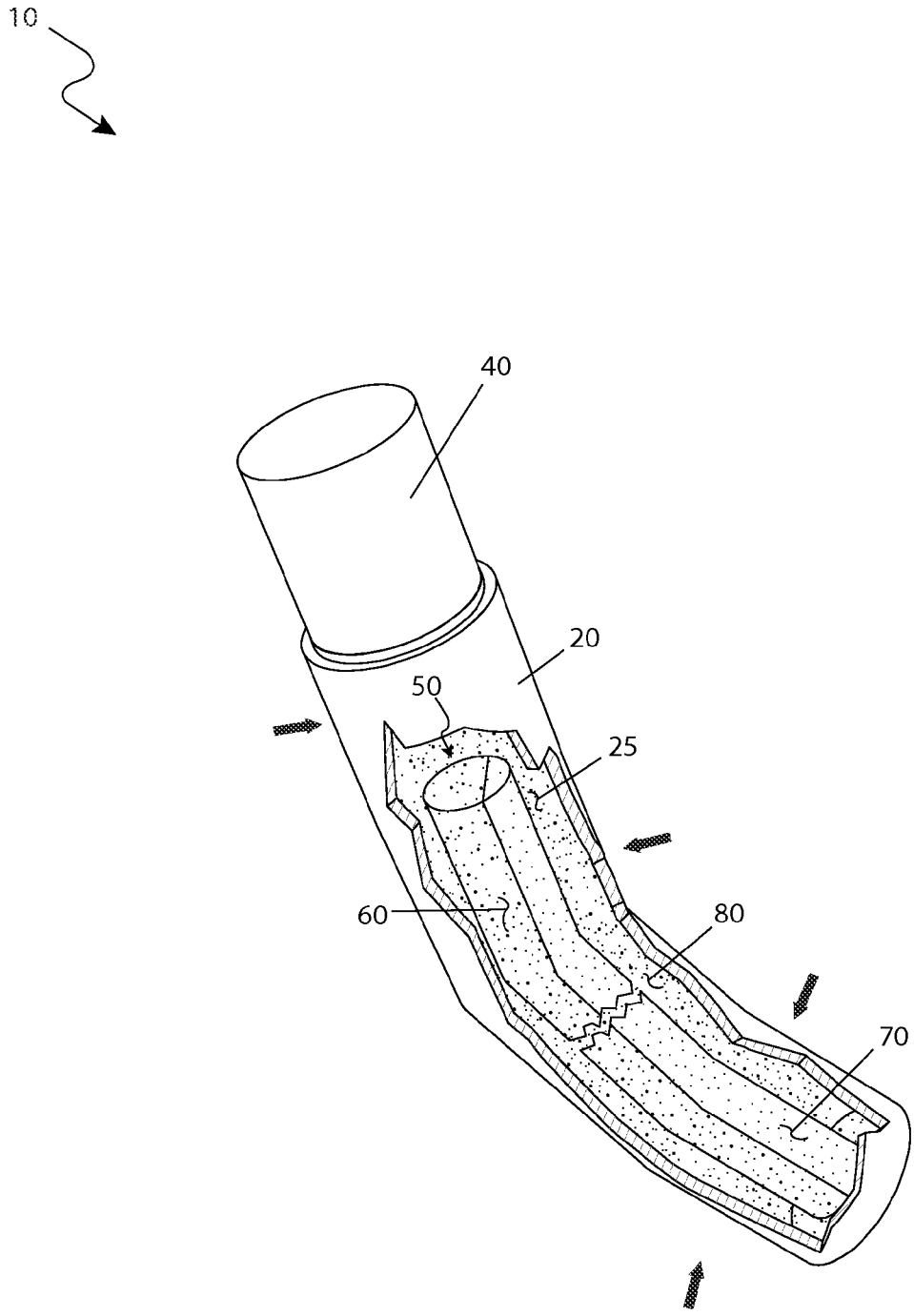
FIG. 4 is a break-away view of the marking and indicating means for emergency personnel 10 depicting a chemical activation state, according to a preferred embodiment of the present invention; and, FIG. 5 is a section view of the marking and indicating means for emergency personnel 10 taken along line B-B (see FIG. 1), according to a preferred embodiment of the present invention.

Referring now to FIG. 2, a break-away view of the apparatus 10 depicting the vial 50, FIG. 3, a section view of the vial 50 taken along line A-A (see FIG. 2), and FIG. 4, a break-away view of the apparatus 10 depicting a chemical activation state, according to the preferred embodiment of the present invention, are disclosed. The first substance 60 and the second substance 70 are contained by a vial 50 and positioned within an interior portion 25 of the container 20. The first substance 60 is preferably phenyl oxalate ester and a fluorescent dye solution, but other chemicals comprising similar chemical properties may be incorporated without limiting the scope of the apparatus 10. The phenyl oxalate ester provides the apparatus 10 with the integral chemiluminescent characteristic. The second substance 70 is comprised of a hydrogen peroxide solution, but other chemicals with the same chemical properties may be incorporated without limiting the scope of the apparatus 10. The second substance 70 mixes with the first substance 60 to yield a chemical reaction which releases energy to excite the dye. The dye then relaxes and releases a photon to produce the light or glow emitted by the apparatus 10. The substances 60, 70 may be modified to a desired intensity to adjust the brightness and duration of the glow. The vial 50 is preferably a glass tube which comprises a divider 55 to separate the substances 60, 70 prior to breaking said vial 50. Once the vial 50 is broken via the external applied pressure which bends the container 20 the substances 60, 70 release into the interior portion 25 to combine together and react to develop a substance mixture 80 which releases light, produced by the fluorescent dye, causing the substances 60, 70 to glow and enabling the user to dispense said substances mixture 80 onto the desired surface. The substance mixture 80 is preferably available in a variety of fluorescent colors to correspond to various user applications.

Figure 5:
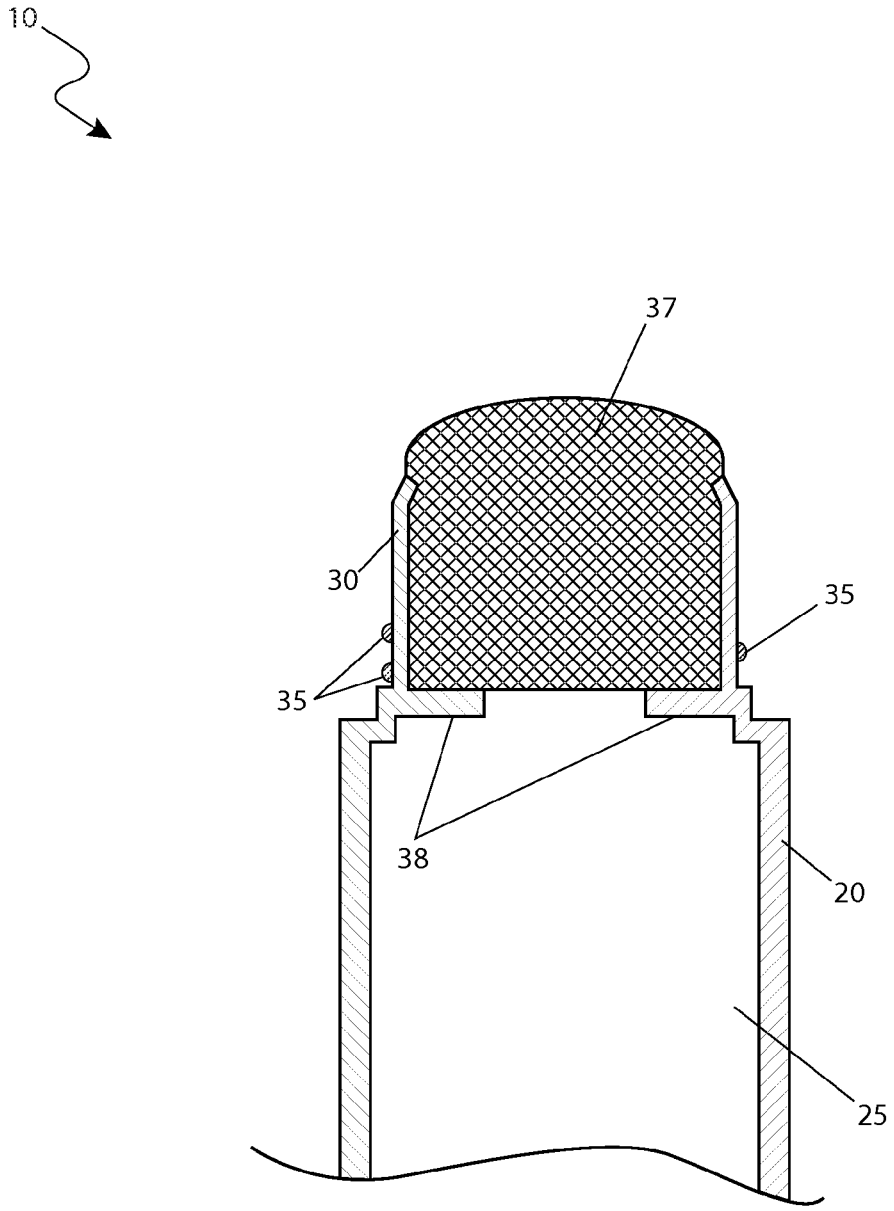

Referring now to FIG. 5, a section view of the apparatus 10 taken along line B-B (see FIG. 1), according to the preferred embodiment of the present invention, is disclosed. FIG. 5 depicts an upper portion of the apparatus 10 and removal of the cap 40 for illustration purposes only. The applicator tip 37 is positioned into the applicator 30 via interference fitting means, yet other techniques such as integral molding may be utilized without limiting the scope of the apparatus 10. The applicator tip 37 rests upon a pair of internal ledges 38 which protrude inwardly from the inner walls of the container 20.

The ledges 38 prohibit the applicator tip 37 from descending into the interior portion 25 and enable the substance mixture 80 to wick into said applicator tip 37 once the container 20 is inverted or squeezed.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 5.

The method of utilizing the apparatus 10 may be achieved by performing the following steps: acquiring the apparatus 10; bending the apparatus 10 to break the vial 50; shaking the apparatus 10 to combine the substances 60, 70; removing the cap 40, thereby disengaging the cap threads 45 from the applicator threads 35; squeezing or inverting the container 20, thereby enabling the substances mixture 80 to load the applicator tip 37 via a wicking means; utilizing the apparatus 10 to mark or indicate a surface via engaging the applicator tip 37 with a desired location; reusing until apparatus 10 is empty and discarding as necessary; and, utilizing the apparatus 10 to provide the ability to mark upon surfaces and have it be seen by others under almost any lighting situation including complete darkness.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A marking and indicating device, comprising:

a container, comprising an interior;

an applicator tip removably inserted into said container and in fluid communication with said interior of said container, located at a marking end of said container;

a cap removably attachable to said container and covering said applicator tip; and, a vial housed within said container, retaining a first reagent and a second reagent therein;

wherein an external force is applied to said vial, thereby breaking said vial and releasing said first reagent and said second reagent into said interior of said container;

wherein when said first reagent and said second reagent interact, a chemical reaction occurs to produce a marking substance;

wherein said marking substance impregnates said applicator, thereby enabling said marking and indicating device to provide a marking means;

wherein said vial further comprises a glass tube having an internal divider thereby separating said first reagent and said second reagent therein; and, wherein said internal divider is monolithically formed with an internal surface of said vial such that said internal divider is prohibited from being slidably displaced within said vial and while said vial is unbroken.

2. The marking and indicating device of claim 1, wherein said container comprises:

a flexible and resilient cylindrical body;

an applicator body extending longitudinally outward along a longitudinal axis from said body, thereby defining said marking end; and, a pair of internal ledges inwardly protruding from inner walls of said container.

3. The marking and indicating device of claim 2, wherein said container comprises approximately seven inches in length.

4. The marking and indicating device of claim 2, wherein said applicator tip further comprises:

a wide-tip porous material that protrudes from said applicator body when inserted therein;

wherein said pair of internal ledges provides a stop for a bottom surface of said applicator tip; and, wherein said applicator tip dispenses and applies said marking substance to a desired surface.

5. The marking and indicating device of claim 4, wherein said applicator tip is approximately one-and-one-eighths square inches.

6. The marking and indicating device of claim 2, wherein said cap further comprises a cylindrical body comprising a diameter coextensive with said container and is removably attachable to said applicator body by a fastening means.

7. The marking and indicating device of claim 1, wherein said first reagent and said second reagent react to form a chemiluminescent marking substance.

8. The marking and indicating device of claim 1, wherein said first reagent is a phenyl oxalate ester and a fluorescent dye solution.

9. The marking and indicating device of claim 7, wherein said second reagent is a hydrogen peroxide solution.

10. A chemiluminescent marking and indicating device, comprising:

a container, further comprising:

a flexible and resilient cylindrical body having an interior;

an applicator body extending longitudinally outward along a longitudinal axis from said body, thereby defining a marking end; and, a pair of internal ledges inwardly protruding from inner walls of said container;

a wide-tip porous applicator tip that protrudes from said applicator body when removably inserted therein and in fluid communication with said interior of said container;

a cap removably attachable to said container and covering said applicator tip; and, a vial housed within said container, comprising an internal divider thereby a first reagent and a second reagent therein;

wherein an external force is applied to said vial, thereby breaking said vial and releasing said first reagent and said second reagent into said interior of said container;

wherein when said first reagent and said second reagent interact, a chemical reaction occurs to produce a chemiluminescent marking substance;

wherein said marking substance impregnates said applicator tip, which dispenses and applies said marking substance to a desired surface; and, wherein said internal divider is monolithically formed with an internal surface of said vial such that said internal divider is prohibited from being slidably displaced within said vial and while said vial is unbroken.

11. The marking and indicating device of claim 10, wherein said container comprises approximately seven inches in length.

12. The marking and indicating device of claim 10, wherein said applicator tip is approximately one-and-one-eighths square inches.

13. The marking and indicating device of claim 10, wherein said cap further comprises a cylindrical body comprising a diameter coextensive with said container and is removably attachable to said applicator body by a fastening means.

14. The marking and indicating device of claim 10, wherein said first reagent is a phenyl oxalate ester and a fluorescent dye solution.

15. The marking and indicating device of claim 10, wherein said second reagent is a hydrogen peroxide solution.

16. A method for marking and indicating a surface with a chemiluminescent marking device comprises the following steps:

providing said marking device, further comprising:

a container, further comprising:

a flexible and resilient cylindrical body having an interior;

an applicator body extending longitudinally outward along a longitudinal axis from said body, thereby defining a marking end; and, a pair of internal ledges inwardly protruding from inner walls of said container;

a wide-tip porous applicator tip that protrudes from said applicator body when removably inserted therein and in fluid communication with said interior of said container;

a cap removably attachable to said container and covering said applicator tip; and, a vial housed within said container, comprising an internal divider thereby retaining a solution of phenyl oxalate ester and a fluorescent dye in a first reservoir and a hydrogen peroxide solution in a second reservoir;

applying an external force to said vial, thereby breaking said vial and releasing said phenyl oxalate ester and fluorescent dye solution and said hydrogen peroxide solution into said interior;

allowing a reaction between said phenyl oxalate ester and fluorescent dye solution and said hydrogen peroxide solution to take place, thereby producing a chemiluminescent dye;

manipulating said container to impregnate said applicator tip with said chemiluminescent dye; and, marking a desired surface with said chemiluminescent marking device, whereby said applicator tip dispenses and applies said chemiluminescent dye;

wherein said internal divider is monolithically formed with an internal surface of said vial such that said internal divider is prohibited from being slidably displaced within said vial and while said vial is unbroken.

17. The method of claim 16, further comprising the steps of:

using said chemiluminescent marking device by emergency personnel to mark a surface of a space of a structure to indicate said space has been investigated;

wherein said chemiluminescent dye enables users to view said dye in levels of low light.

* * * * *